US010184763B2

(12) United States Patent
Bootes et al.

(10) Patent No.: US 10,184,763 B2
(45) Date of Patent: Jan. 22, 2019

(54) MUNITION WITH NOSE KIT CONNECTING TO AFT CASING CONNECTOR

(71) Applicant: Raytheon Company, Waltham, MA (US)

(72) Inventors: Thomas H. Bootes, Tucson, AZ (US); George D. Budy, Tucson, AZ (US); Wayne Y. Lee, Santaquin, UT (US); Richard K. Polly, Tucson, AZ (US); Jason M. Shire, Tucson, AZ (US); Jesse T. Waddell, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 224 days.

(21) Appl. No.: 15/117,893

(22) PCT Filed: Feb. 11, 2015

(86) PCT No.: PCT/US2015/015427

§ 371 (c)(1),
(2) Date: Aug. 10, 2016

(87) PCT Pub. No.: WO2015/175039

PCT Pub. Date: Nov. 19, 2015

(65) Prior Publication Data

US 2018/0156585 A1 Jun. 7, 2018

Related U.S. Application Data

(60) Provisional application No. 61/986,985, filed on May 1, 2014, provisional application No. 61/938,297, filed on Feb. 11, 2014.

(51) Int. Cl.
*F42B 12/20* (2006.01)
*F42B 12/22* (2006.01)
(Continued)

(52) U.S. Cl.
CPC ..... *F42B 12/204* (2013.01); *F42B 12/04* (2013.01); *F42B 12/22* (2013.01); *F42B 12/24* (2013.01);
(Continued)

(58) Field of Classification Search
CPC ..... F42C 19/02; F42B 12/24; F42B 12/204
(Continued)

(56) References Cited

U.S. PATENT DOCUMENTS 1,006,875 A 10/1911 Puff
1,300,333 A 4/1919 Berry
(Continued)

FOREIGN PATENT DOCUMENTS

CH 649627 A5 5/1985
DE 2557676 A1 6/1977
(Continued)

OTHER PUBLICATIONS

International Search Report for corresponding International Application No. PCT/US2015/015427 dated Nov. 24, 2015.
(Continued)

*Primary Examiner* — John Cooper
(74) *Attorney, Agent, or Firm* — Renner, Otto, Boisselle & Sklar, LLP

(57) ABSTRACT

A munition, such as a warhead, includes a penetrator casing for penetrating hard targets, such as a fortification or reinforced building or other structure. The penetrator casing has a relatively thick nose, and a relatively thin aft section extending back from the nose. A cable interface is in the aft section, and an electrical harness extends from the cable interface, external of the casing, and forward to a nose kit. The penetrator casing may have reduced-thickness portions, to provide weakness points to the casing that facilitate the casing being transformed into fragments of a semi-con-
(Continued)

trolled and desirable size when an explosive within the casing is detonated after the penetration occurs, thus enhancing the effectiveness of the munition.

18 Claims, 5 Drawing Sheets

(51) Int. Cl.

| | |
|---|---|
| ***F42B 25/00*** | (2006.01) |
| ***F42C 19/02*** | (2006.01) |
| ***F42B 12/04*** | (2006.01) |
| ***F42B 12/24*** | (2006.01) |
| ***F42B 12/32*** | (2006.01) |

(52) U.S. Cl.
CPC ..... *F42B 12/32* (2013.01); *F42B 25/00* (2013.01); *F42C 19/02* (2013.01)

(58) Field of Classification Search
USPC ..... 102/506
See application file for complete search history.

(56) References Cited

U.S. PATENT DOCUMENTS

| | | | | |
|---|---|---|---|---|
| 2,337,765 | A | 12/1942 | Nahirney | |
| 2,972,950 | A | 2/1961 | Welanetz | |
| 3,134,330 | A | 5/1964 | Batou | |
| 3,474,731 | A | 10/1969 | Thomanek | |
| 3,744,419 | A | 7/1973 | Hand | |
| 3,820,464 | A | 6/1974 | Dixon | |
| 3,981,243 | A | 9/1976 | Doris, Jr. | |
| 4,063,512 | A * | 12/1977 | Davis | F42B 1/028 102/476 |
| 4,327,643 | A | 5/1982 | Lasheras Barrios | |
| 4,353,305 | A | 10/1982 | Moreau et al. | |
| 4,524,696 | A | 6/1985 | Altenau et al. | |
| 4,592,283 | A | 6/1986 | Hellner et al. | |
| 4,648,323 | A | 3/1987 | Lawther | |
| 4,664,035 | A | 5/1987 | Osofsky | |
| 4,693,317 | A | 9/1987 | Edwards et al. | |
| 4,882,996 | A | 11/1989 | Bock et al. | |
| 4,896,607 | A * | 1/1990 | Hall | F42C 11/06 102/247 |
| 5,078,051 | A * | 1/1992 | Amundson | F42C 17/04 102/206 |
| H1048 | H | 5/1992 | Wilson et al. | |
| 5,117,759 | A | 6/1992 | Henderson et al. | |
| 5,131,329 | A | 7/1992 | Lips et al. | |
| 5,305,505 | A | 5/1994 | Ruhlman | |
| 5,313,890 | A | 5/1994 | Cuadros | |
| 5,535,679 | A | 7/1996 | Craddock | |
| 5,656,792 | A * | 8/1997 | Rentzsch | F42B 12/625 102/473 |
| 5,698,814 | A | 12/1997 | Parsons et al. | |
| 5,717,397 | A | 2/1998 | Ruszkowski, Jr. | |
| 5,852,256 | A * | 12/1998 | Hornig | F42B 12/204 102/473 |
| 5,939,662 | A | 8/1999 | Bootes et al. | |
| 6,105,505 | A | 8/2000 | Jones | |
| 6,135,028 | A | 10/2000 | Kuhns et al. | |
| 6,186,072 | B1 | 2/2001 | Hickerson, Jr. et al. | |
| 6,374,744 | B1 | 4/2002 | Schmacker et al. | |
| 6,389,977 | B1 | 5/2002 | Schmacker et al. | |
| 6,484,642 | B1 | 11/2002 | Kuhns et al. | |
| 6,523,477 | B1 | 2/2003 | Brooks et al. | |
| 6,601,517 | B1 | 8/2003 | Guirguis | |
| 6,619,210 | B1 | 9/2003 | Spivak et al. | |
| 6,659,013 | B1 | 12/2003 | Kellner | |
| 7,152,532 | B2 | 12/2006 | Conrad | |
| 7,231,876 | B2 | 6/2007 | Kellner | |
| 7,614,348 | B2 | 11/2009 | Truitt et al. | |
| 7,971,533 | B1 | 7/2011 | Berlin et al. | |
| 8,061,275 | B1 | 11/2011 | Gold | |
| 8,161,884 | B1 | 4/2012 | Kokodis et al. | |
| 8,176,849 | B1 | 5/2012 | Gold et al. | |
| 8,191,479 | B2 | 6/2012 | Ruhlman et al. | |
| 8,234,979 | B1 | 8/2012 | Falabella et al. | |
| 8,387,539 | B1 | 3/2013 | Maines | |
| 8,671,840 | B2 | 3/2014 | Scheid et al. | |
| 8,701,557 | B2 | 4/2014 | Biggs et al. | |
| 9,291,437 | B2 | 3/2016 | Bonnstetter et al. | |
| 9,423,226 | B2 | 8/2016 | Cillaut et al. | |
| 9,683,822 | B2 | 6/2017 | Kerns et al. | |
| 9,816,793 | B2 | 11/2017 | Budy et al. | |
| 2003/0167956 | A1 | 9/2003 | Kellner | |
| 2003/0172833 | A1 | 9/2003 | Ronn et al. | |
| 2005/0087088 | A1 * | 4/2005 | Lacy | F42B 12/24 102/495 |
| 2005/0115450 | A1 | 6/2005 | Lloyd | |
| 2005/0223930 | A1 | 10/2005 | Bootes et al. | |
| 2005/0235862 | A1 | 10/2005 | Gousman et al. | |
| 2008/0019386 | A1 | 1/2008 | Chen et al. | |
| 2010/0032515 | A1 | 2/2010 | Geswender et al. | |
| 2010/0199875 | A1 * | 8/2010 | Weihrauch | F42B 12/208 102/492 |
| 2011/0162548 | A1 | 7/2011 | Berlin et al. | |
| 2012/0017795 | A1 | 1/2012 | Dryer et al. | |
| 2012/0227609 | A1 | 9/2012 | Volkmann | |
| 2012/0291651 | A1 | 11/2012 | Haumann et al. | |
| 2014/0299012 | A1 | 10/2014 | Odintsov | |
| 2016/0025467 | A1 | 1/2016 | Botthof et al. | |
| 2016/0377396 | A1 | 12/2016 | Bootes et al. | |
| 2018/0156586 | A1 | 6/2018 | Bootes et al. | |

FOREIGN PATENT DOCUMENTS

| | | | |
|---|---|---|---|
| EP | 1001244 | A1 | 5/2000 |
| EP | 1316774 | A1 | 6/2003 |
| EP | 1367358 | A2 | 12/2003 |
| EP | 1864960 | A2 | 4/2007 |
| EP | 2095059 | B1 | 6/2010 |
| FR | 2910612 | A1 | 6/2008 |
| GB | 2384291 | A | 11/1993 |
| JP | 2008-261627 | A | 10/2006 |
| WO | 98/30863 | A1 | 7/1998 |
| WO | 9830863 | A1 | 7/1998 |
| WO | 0203008 | A1 | 1/2002 |
| WO | 2008089078 | A2 | 7/2008 |
| WO | 2008096069 | A1 | 8/2008 |
| WO | 2009102254 | A1 | 8/2009 |
| WO | 2011054361 | A1 | 5/2011 |
| WO | 2011054361 | A1 | 12/2011 |
| WO | 2015175036 | A2 | 11/2015 |
| WO | 2015175037 | A2 | 11/2015 |
| WO | 2015175038 | A2 | 11/2015 |
| WO | 2015175039 | A2 | 11/2015 |
| WO | 2015175040 | A2 | 11/2015 |
| WO | 2016022181 | A1 | 2/2016 |
| WO | 2016022199 | A1 | 2/2016 |

OTHER PUBLICATIONS

Written Opinon for corresponding International Application No. PCT/US2015/015427 dated Nov. 24, 2015.

* cited by examiner

MUNITION WITH NOSE KIT CONNECTING TO AFT CASING CONNECTOR

This application claims priority to U.S. Provisional Application 61/938,297, filed Feb. 11, 2014, and to U.S. Provisional Application 61/986,985, filed May 1, 2014. Both of these applications are incorporated by reference in their entireties.

FIELD OF THE INVENTION

The present invention generally relates to munitions useable for attacking hard targets, such as buildings or fortifications.

DESCRIPTION OF THE RELATED ART

Weapons for penetrating hard targets, such as buildings or fortifications having reinforced concrete walls, have generally used steel casings to survive challenging impact conditions against hardened target structures. Using solid steel cased cylindrical wall structures that protect the explosive payload during penetration has been the standard. However, this approach results in relatively low numbers of large naturally formed steel cased fragments upon warhead detonation inside the hardened target.

SUMMARY OF THE INVENTION

A warhead for a munition, such as a missile or bomb, has a penetration casing with reduced-thickness portions that selectively weaken parts of the casing. This allows enhanced formation of fragments from the casing when an explosive enclosed by the casing is detonated, such as after the warhead has penetrated a hardened target. The reduced-thickness portions may be non-intersecting portions where the casing has holes therein, or grooves on an outer and/or inner surface of the casing. A lethality-enhancement material, for example including preformed fragments or an energetic material, may be placed at the reduced-thickness portions (e.g., in the holes or the grooves) to further enhance effectiveness.

According to an aspect of the invention, a munition comprising; a penetrator casing; an explosive within the casing; a fuze for detonating the explosive; and a cable coupled to a fuze for providing a detonation signal to the fuze; wherein the penetrator casing has a nose, and an aft section extending back from the nose; wherein the nose has a thickest portion that is at least twice the thickness of the aft section; and wherein the cable interfaces with an interface in the aft section of the penetrator casing.

According to another aspect of the invention, a munition includes: a penetrator casing; an explosive within the casing; a fuze for detonating the explosive; a cable coupled to a fuze for providing a detonation signal to the fuze; and an external electrical harness that electrically couples to the cable. The external electrical harness runs outside of the penetrator casing, forward of the interface. The penetrator casing has a relatively thick nose, and a relatively thin aft section extending back from the nose. The cable interfaces with an interface in the aft section of the penetrator casing.

In some embodiments the cable is connected to a coupling at the opening in the aft section.

In some embodiments the munition includes an external electrical harness that electrically couples to the cable; the external electrical harness runs outside of the penetrator casing, forward of the interface.

In some embodiments the munition includes an enclosure around an outside of the penetrator casing.

In some embodiments the enclosure is a clamshell enclosure.

In some embodiments the munition includes a nose kit forward of the penetrator casing.

In some embodiments the electrical harness is coupled to the nose kit.

In some embodiments the nose kit is coupled to a forward connection of an enclosure around an outside of the penetrator casing.

In some embodiments the munition includes a tail kit aft of the penetrator casing.

In some embodiments the tail kit is coupled to an aft connection of an enclosure around an outside of the penetrator casing.

In some embodiments the casing has a series of non-intersecting elongate reduced-thickness portions, thinner than portions of the casing that are adjacent the reduced-thickness portions.

In some embodiments the penetrator casing has a nose, and an aft section extending back from the nose; the reduced-thickness portions are parts of the aft section; and the nose has a thickest portion that is at least twice the thickness of the portions of the casing that are adjacent the reduced-thickness portions.

In some embodiments the aft section is substantially cylindrical.

In some embodiments the elongate reduced-thickness portions are parallel to one another.

In some embodiments the elongate reduced-thickness portions extend in straight lines.

In some embodiments the elongate reduced-thickness portions extend substantially parallel to a longitudinal axis of the warhead.

In some embodiments the elongate reduced-thickness portions are portions in which the casing has holes therein.

In some embodiments the holes include a series of longitudinal holes therein, separated circumferentially around the penetrator casing.

In some embodiments the elongate reduced-thickness portions are portions in which the casing has grooves therein. The grooves may be on an inside surface of the casing. Alternatively or in addition the grooves may be on an outside surface of the casing.

In some embodiments the munition includes a fuzewell within the penetrator casing.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A munition, such as a warhead, includes a penetrator casing for penetrating hard targets, such as a fortification or reinforced building or other structure. The penetrator casing has a relatively thick nose, and a relatively thin aft section extending back from the nose. A cable interface is in the aft section, and an electrical harness extends from the cable interface, external of the casing, and forward to a nose kit. The penetrator casing may have reduced-thickness portions, to provide weakness points to the casing that facilitate the casing being transformed into fragments of a semi-controlled and desirable size when an explosive within the casing is detonated after the penetration occurs, thus enhancing the effectiveness of the munition.

In what follows, a general description of a munition with a penetrator warhead is given first, with the munition including a penetrator case having a cable interface for connection to a nose kit. Then further details of the cable interface and connection are provided.

Figure 1:
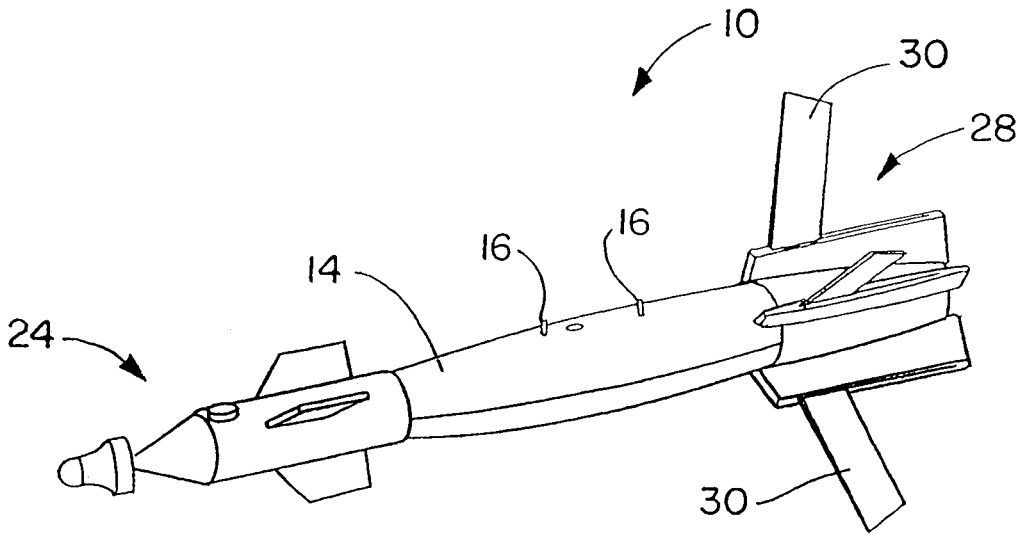
FIG. 1 is an oblique view of a munition in accordance with the present invention.
Figure 2:
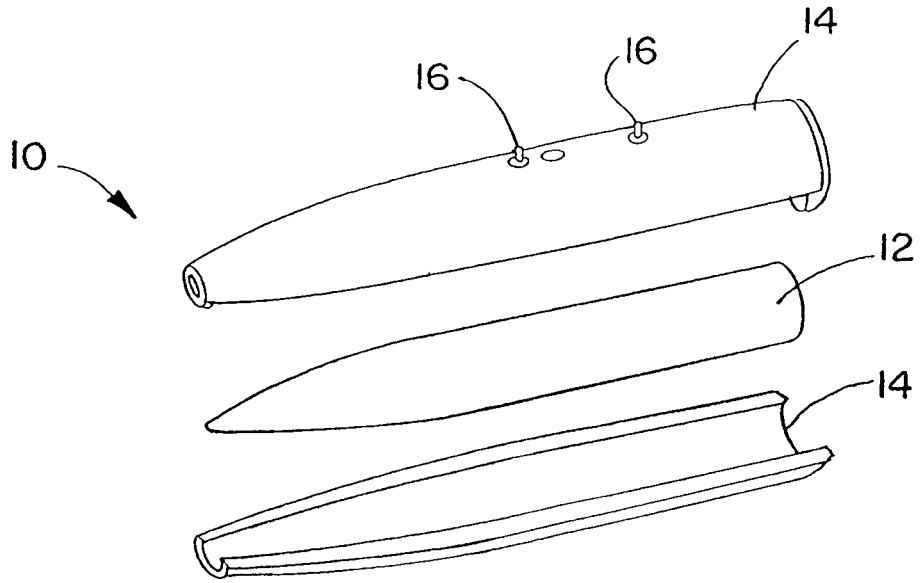
FIG. 2 is an exploded view showing parts of the munition of FIG. 1.
Figure 3:
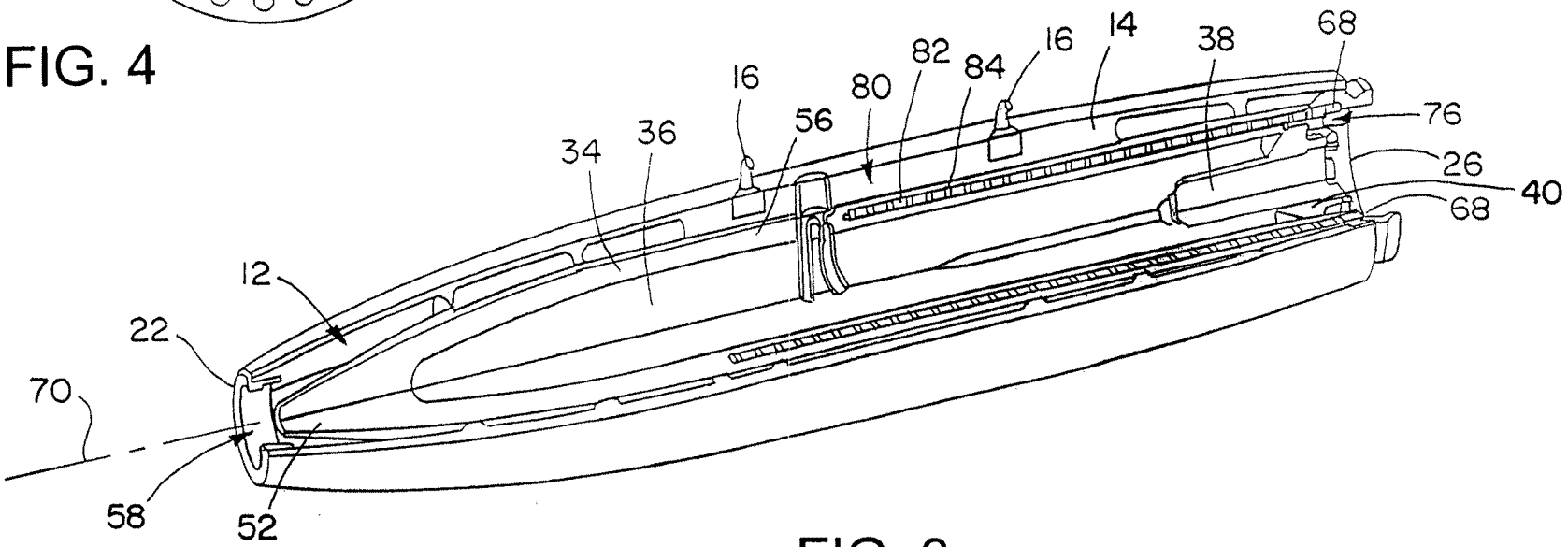
FIG. 3 is an oblique partial cutaway view showing details of a warhead of the munition of FIG. 1.

Referring initially to FIGS. 1-3, a munition 10, such as a missile or guided bomb, has a warhead 12 that is contained within an airframe 14 that has connection lugs 16 for connection to an aircraft or other platform for launching the munition 10. The airframe 14 has a forward connection 22 for receiving a guidance nose kit 24 (for example), and an aft connection 26 for receiving (for example), a tail kit 28 with deployable fins 30. The airframe 14 may be configured for using a standard weapons mount on a launch platform that is also able to receive other types of weapons. The connections 22 and 26 may be standard connections that are similar to those used for other munitions, thus enabling use of standard nose and tail kits that may be used with other sorts of munitions. The airframe 14 may be in the form of a pair of clamshell halves that fit around the warhead 12, and may be made of a relatively lightweight material, such as aluminum.

The warhead 12 has a penetrator casing 34 that encloses an explosive 36. The explosive 36 is detonated by a fuze 38 that is at an aft end of the explosive 36, in a fuzewell 40. The casing 34 has a forward nose 52, and an aft section 56 extending back from the nose 52. In the illustrated embodiment, the forward nose 52 of the penetrator case 34 is solid in nature, a monolithic structure with no cutout or through holes to accommodate forward mounted fuzing such as that used in general purpose bomb cases. The forward nose 52 is thickest at an apex 58 of the nose 52, and has a thickness that reduces the farther back you go along the casing 34, tapering gradually to the thickness of the substantially cylindrical aft section 56. The nose 52 may have a maximum thickness that is at least twice the thickness of the thickest part of the casing 34 in the cylindrical aft section 56.

Figure 4:
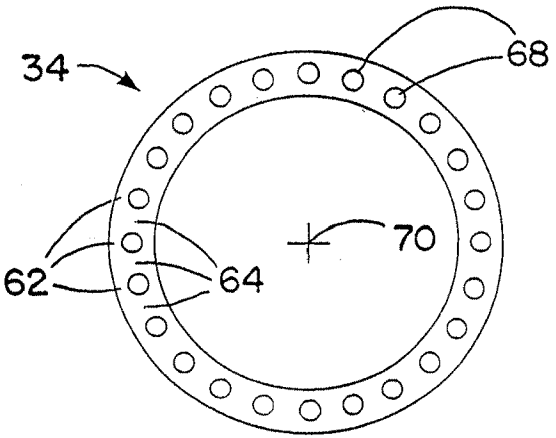
FIG. 4 is an end view showing details of a casing of the warhead of FIGS. 2 and 3.

With reference in addition to FIG. 4, the aft section 56 has a series of reduced-thickness portions 62 that are adjacent to other portions 64 of the aft section 56 that do not have a reduced thickness. The reduced-thickness portions 62 introduce weakness into parts of the penetrator casing 34, facilitating break-up of the casing 34 when the explosive 36 is detonated. This may enhance the production of fragments from all or part of the casing 34 when the explosive 36 is detonated, enhancing the lethality of the warhead 12.

In the illustrated embodiment the reduced-thickness portions 62 are a series of holes 68 that are parallel to a longitudinal axis 70 of the warhead 12. The holes 68 do not intersect with one another, and are distributed circumferentially about the aft section 56. The holes 68 may be substantially evenly distributed in the circumferential direction around the aft section 56, although a non-even distribution is a possible alternative. The use of the holes 68 to produce the reduced-thickness portions 62 is just one possible configuration. Alternatives, such as notches or grooves on the inner and/or outer surfaces of the aft section 56, may also be used.

The reduced-thickness portions 62 in the illustrated embodiment are non-intersecting, and are elongate, having lengths (in the axial or longitudinal direction) that are for example of at least ten times their widths (in the circumferential direction). The reduced-thickness portions 62 may be substantially identical in their lengths, widths, and reduction in thickness of material, although alternatively the reduced-thickness portions 62 may vary from one to another with regard to one or more of these parameters.

The aft section 56 may have a thickness of 1.9 to 5.1 cm (0.75 to 2 inches). The holes 68 may have a diameter of about 1.27 cm (0.5 inches), or more broadly from 0.31 to 1.9 cm (0.125 to 0.75 inches). These values are only examples, and a wide variety of other values are possible.

The holes 68 may be filled with a lethality-enhancement material 76, to further increase the effectiveness of the warhead 12. In the illustrated embodiment, the holes 68 are filled with preformed fragments 80. The fragments 80 may include fragments with different materials, different shapes, and/or different sizes, although as an alternative all of the fragments may be substantially identical in material, size, and shape. Other materials, such as spacers, may be placed between the hard preformed fragments.

The fragments 80 may each be 0.3 to 450 grams (5 to 7000 grain weights), for example. The fragments 80 may be spheres, cubes, cylinders, flechetts, parallelepipeds, uncontrolled solidification shapes (such as used in HEVI-SHOT shotgun pellets), to give a few non-limiting examples. The material for the fragments 80 may be one or more of steel, tungsten, aluminum, tantalum, lead, titanium, zirconium, copper, molybdenum, etc. There may be a wide range of the number of the fragments 80 in the munition 10, with as few as 10 fragments for a small warhead, to as many as 1,000,000 for very large munitions.

One advantage of the munition 10 is that it provides flexibility and adaptability for fragment sizes, weights, and shapes. These parameters are tailorable in accordance with mission requirements. Smaller fragments, for example the size of pebbles, are more suitable for localized full coverage, while larger fragment sizes allow more observable damages within the target site.

The fragments 80 are projected outward from the warhead 12 when the explosive 36 is detonated. Thus the warhead 12 has the characteristics of both a penetrator weapon and a fragmentation weapon. The penetrator casing 34 remains intact as the warhead 12 strikes a hard target, such as a concrete building, allowing the warhead to penetrate into the hard target, perhaps to an interior space that may be occupied by targeted personnel. Then the fuze 38 detonates the explosive 36. This causes the casing 34, because of the weakness introduced by the reduced-thickness portions 62, to break up into fragments that can do damage within the hard target. In addition the preformed fragments 80 may enhance the fragmentation effect of the warhead 12.

The lethality-enhancement material 76 may alternatively or in addition include energetic materials, such as chemically-reactive materials. For example, the fragments 80 may be spaced apart, with energetic material placed between adjacent of the fragments within the holes 68. The energetic material may be or may include any of a variety of suitable explosives and/or incendiaries, for example hydrocarbon fuels, solid propellants, incendiary propellants, pyroforic metals (such as zirconium, aluminum, or titanium), explosives, oxidizers, or combinations thereof. Detonation of the explosive 36 may be used to trigger reaction (such as detonation) in the energetic material that is located at the reduced-thickness portions 62. This adds further energy to the detonation, and may aid in propelling the fragments 80 and/or in breaking up the penetrator casing 34 into fragments.

The penetrator casing 34 may be made out of a suitable metal, such as a suitable steel (for example 4340 steel) or another hard material, such as titanium. Aluminum and composite materials are other possible alternatives. An example of a suitable material for the explosive 36 is PBXN-109, a polymer bonded explosive.

The holes 68 may be through holes, or may be blind holes that only go to a specific depth. The depth of blind holes may all be the same, or may vary according to achieve some desired effect, or due to system-level requirements such as varying hole length due to aircraft mounting lugs for example. The holes 68 may be made by machining, for example by drilling, or may be made by other suitable processes, such as acid etching. In the illustrated embodiment the holes 68 are only in the aft casing section 56, but as an alternative there may be holes or other reduced-thickness portions of parts of the nose 52.

Figure 5:
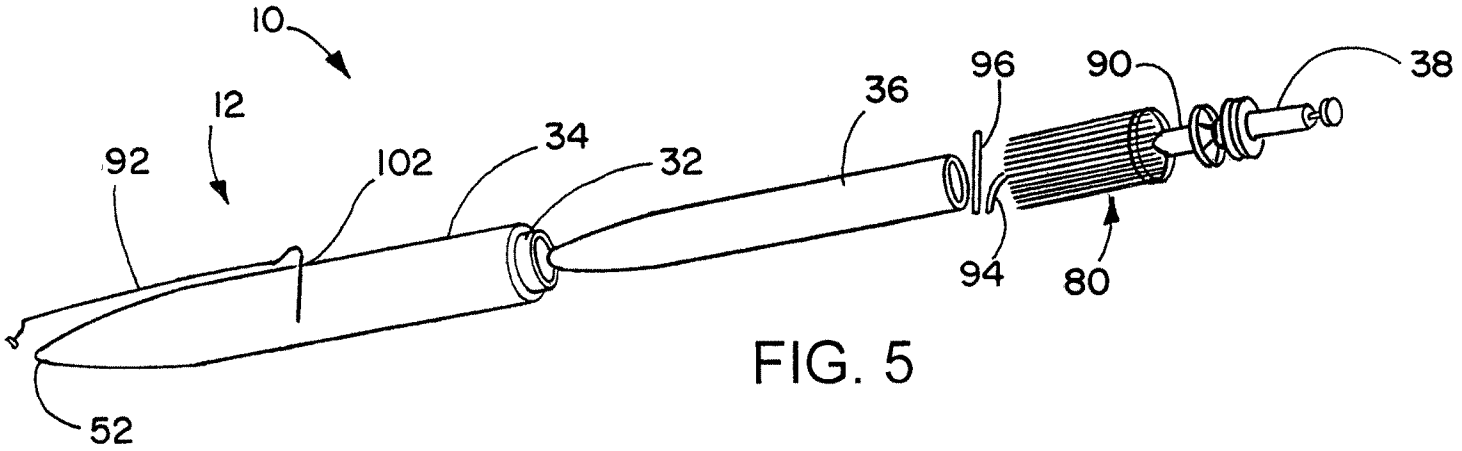
FIG. 5 is an exploded view of some components of the munition of FIG. 1.
Figure 6:
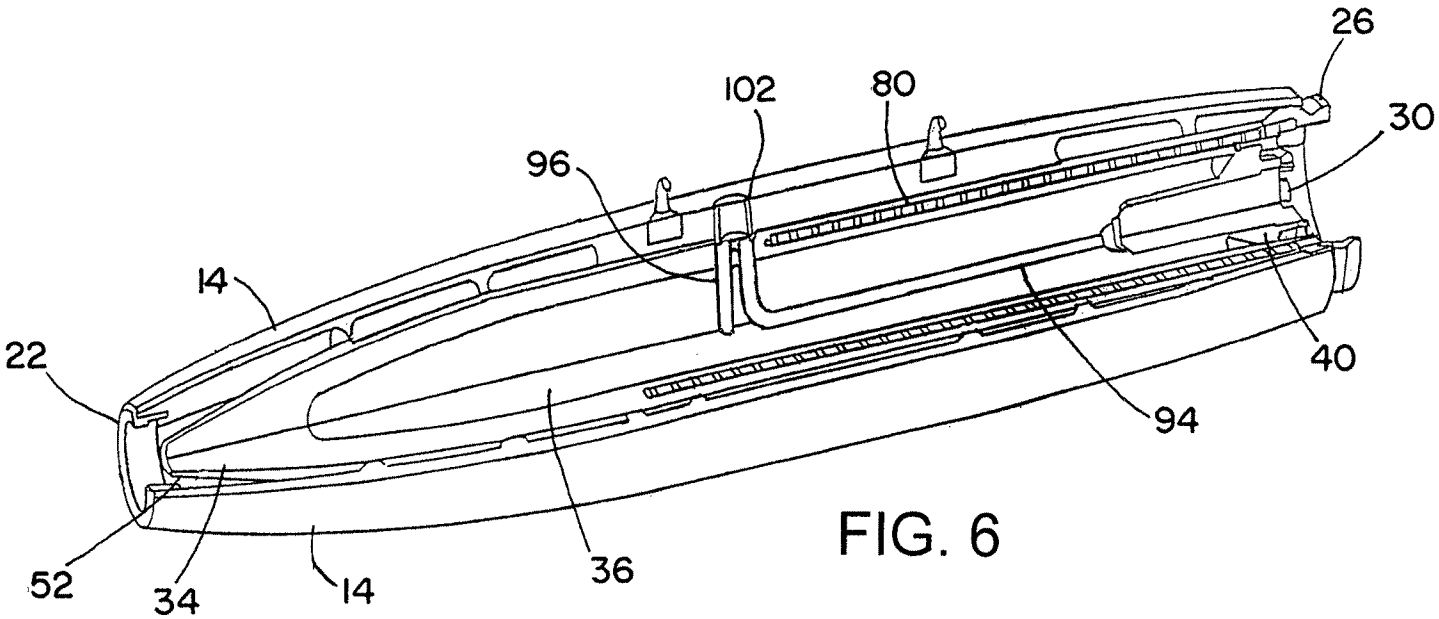
FIG. 6 is a partial sectional alternate view of the warhead of the munition of FIG. 1.

With reference now to FIGS. 5 and 6, further details of the munition 10 (or a close variant thereof) are shown. The airframe 14 has the forward connection 22 for receiving the nose kit 24 (FIG. 1), and the aft connection 26 for receiving the tail kit 28 (FIG. 1) with deployable fins 30. Focusing on aspects of the munition 10 that are not described earlier, the warhead 12 includes an asphaltic liner 32 between a penetrator casing 34 and an explosive 36. The asphaltic liner 32 serves as a sealing material and protective layer for the explosive 36 during storage, transportation and target penetration.

The fuze 38 is used to detonate the explosive 36. As discussed earlier, the fuze 38 is located in the fuzewell 40 located at an aft end of the munition 12. The fuze 38 is operably coupled to the nose kit 24, for example to receive from the nose kit 24 a signal to detonate the fuze 38. The nose kit 24 may include a sensor or other device that it is used to provide a signal to trigger the firing of the fuze 38. The triggering event may be the munition 10 reaching a desired height for detonation (height of burst), for example.

The connection between the nose kit 24 and the fuze 38 includes an external electrical harness 92 and an internal electrical line or cord (or cable) 94 that runs through a conduit 96 (FIG. 6) that is inside the explosive 36. The conduit 96 is perpendicular to the central axis of the warhead 12, and spans the diameter of the casing 34. The harness 92 runs outside of the casing 34, between the casing 34 and the airframe 14. A forward end of the harness 92 is coupled to the nose kit 24 at the forward connection 22, near the nose 52 of the casing 34. An aft end of the harness 92 is connected to a coupling 102 in the middle of the casing 34. The aft end of the harness 92 enters the conduit 96 from the opposite side of the casing 34 from the coupling 102. The aft end of the harness 92 passes all the way through the warhead 10, to the coupling 102. From the coupling 102 the signal travels back to the fuze through the electrical line or cable 94. An umbilical cable (not shown) may also be connected to the fuze 38, to provide data, instructions, or other information to the munition 10 prior to launch.

Lethality may be enhanced by providing additional fragments between the airframe 14 and the casing 34. The additional fragments may be loose, may be fragmentation packs in pockets or openings in the airframe 14, or may be in the form of cast fragmentation. Other lethality enhancement materials, such as explosives, may also possibly be included between the casing 34 and the airframe 14.

Figure 7:
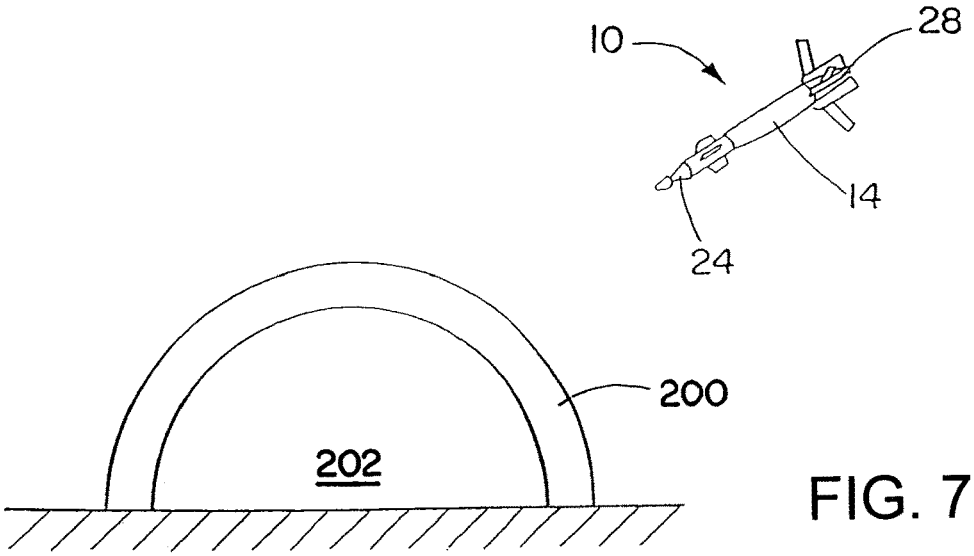
FIG. 7 is a side view illustrating a first step in the use of the munition of FIG. 1 as a hard target penetrator.
Figure 8:
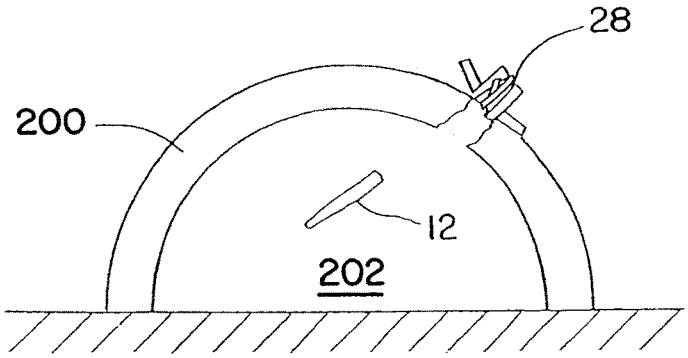
FIG. 8 is a side view illustrating a second step in the use of the munition as a hard target penetrator.
Figure 9:
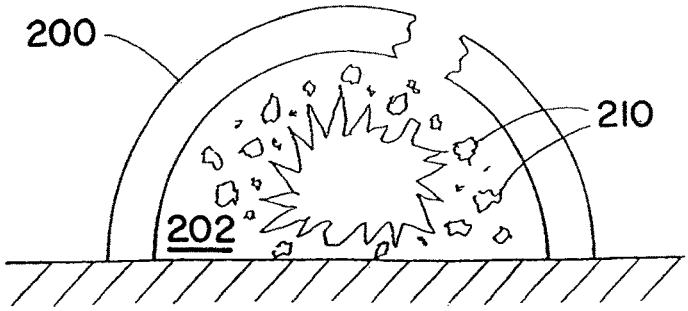
FIG. 9 is a side view illustrating a third step in the use of the munition as a harden target penetrator.

FIGS. 7-9 illustrate use of the munition 10 in a target penetration mode. In FIG. 7 the munition 10 is shown approaching a hard target 200. FIG. 8 shows the munition 10 impacting the hard target 200. Only the warhead 12, with its penetrator casing 34, is able to penetrate the hard target 200 to reach an inner area 202 of the hard target 200. The other parts of the munition, such as the airframe 14, the nose kit 24, and the tail kit 28, are destroyed and/or are separated from the warhead 12 by the collision with the hard target 200.

FIG. 9 illustrates the fragmentation effect of the warhead 12 after penetration. The illustration shows the situation after the explosive 36 has been detonated. Fragments 210 are spread within the hard target inner area 202 by the explosion. The fragments 210 include fragments produced by the destruction of the penetration casing 34, and perhaps other preformed fragments that were located in the holes 68 within the casing 34.

Figure 10:
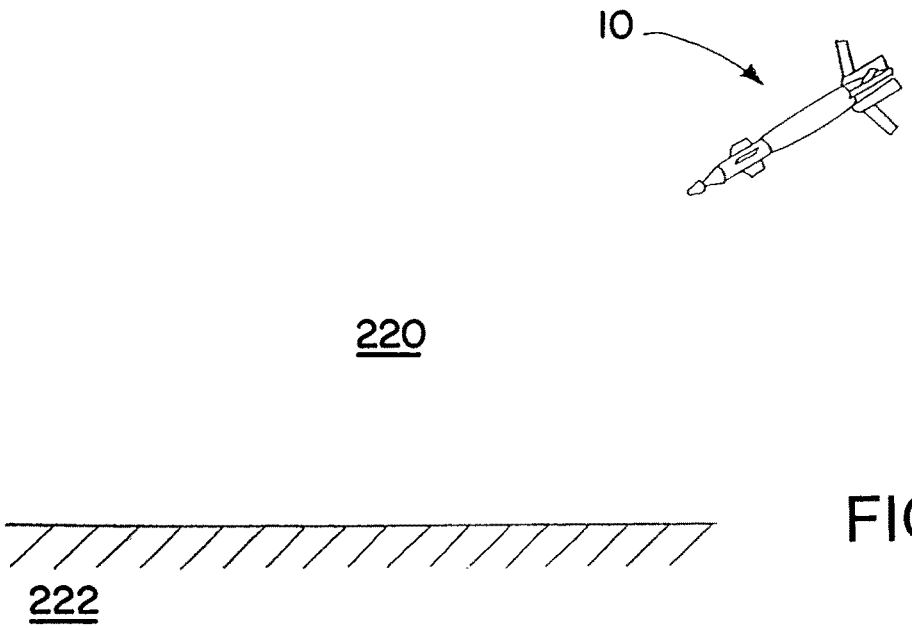
FIG. 10 is a side view illustrating a first step in the use of the munition of FIG. 1 in a fragmentation mode.
Figure 11:
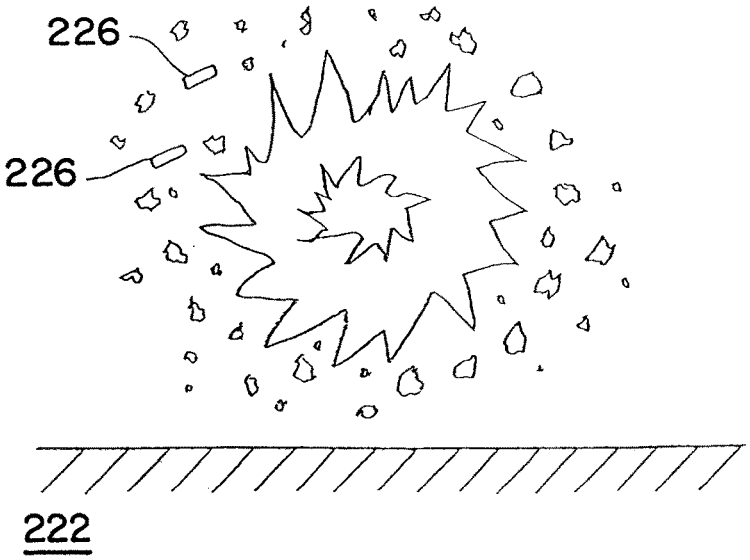
FIG. 11 is a side view illustrating a second step in the use of the munition in a fragmentation mode.

FIGS. 10 and 11 illustrate the use of the munition 10 as a fragmentation weapon, without penetration. FIG. 9 shows the munition 10 in a steep dive, approaching a desired detonation location 220 above the ground 222. The fuze 38 (FIG. 3) may be set to provide detonation at a desired height, and different heights may be used for different types of engagement (different types of soft targets, and spreads over different areas). As an example, the desired detonation location 220 may be 3-4 meters above the ground 222, although a wide variety of other detonation heights are possible.

FIG. 11 illustrates the detonation at the location 220. The detonation spreads fragments 126 about the area near the detonation location 220. As with the detonation illustrated in FIG. 8, the fragments 226 may include both pieces of the penetrator casing 34 (FIG. 3), and the preformed fragments 80 (FIG. 3). The fragmentation mode shown in FIGS. 10 and 11 may be useful for attacking soft targets that spread out to some degree, such as enemy personnel out in the open. The use of the reduced-thickness portions 62 (FIG. 4) and the inclusion of the fragments 80 (FIG. 3) in warhead 12 has been found to account for over 70% of the fragments that are sent forth by the munition 10.

The enhanced fragmentation provided by the munition 10 may allow more effective engagement of both soft and hard targets, as well flexibility in using a single munition in multiple modes, by use of the fuze 38 to control whether detonation occurs at a height above ground, or only after penetration of a hard target. The target selection (the mode of hard versus soft, the fuze delay, and/or the height of bust control setting) may be controlled in any of multiple ways: 1) preset by the ground crew before weapon launch for some systems; 2) controlled from the aircraft or other launcher before weapon launch by the pilot or ground control for some systems; and/or 3) controlled after weapon launch via a data link. The use of the reduced-thickness portions 62 (FIG. 4) and the inclusion of the fragments 80 (FIG. 3) has been found to account for over 70% of the fragments that are sent forth by the munition 10.

The use of the external electrical 92, and its ability to connect the nose kit 24 to the fuze 38, through the electrical connection 102, enables many of the benefits of the munition 10. In particular, in order to have a hybrid munition that can be used for both target penetration and as an area fragmentation weapon, it is advantageous to not have the connection to the nose kit at the nose of the warhead, as this could compromise the ability to penetrate hard targets.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A munition comprising:

a penetrator casing;

an explosive within the casing;

a fuze for detonating the explosive;

a cable coupled to a fuze for providing a detonation signal to the fuze; and an external electrical harness that electrically couples to the cable;

wherein the penetrator casing has a relatively thick nose, and a relatively thin aft section extending back from the nose, wherein the relatively thin aft section is thinner than the relatively thick nose;

wherein the cable interfaces with an interface in the aft section of the penetrator casing;

wherein the external electrical harness runs outside of the penetrator casing, forward of the interface;

wherein the munition includes an enclosure around an outside of the penetrator casing; and wherein the interface allows connection through the enclosure.

2. The munition of claim 1, wherein the cable is connected to a coupling at the interface in the aft section.

3. The munition of claim 1, wherein the nose has a thickest portion that is at least twice the thickness of the aft section.

4. The munition of claim 1, wherein the electrical harness is coupled to the interface after first passing through a conduit that is through the casing; and wherein the conduit is perpendicular to a central axis of the munition, and spans a diameter of the casing.

5. The munition of claim 1, wherein the enclosure is a clamshell enclosure.

6. The munition of claim 1, wherein the munition includes a nose kit forward of the penetrator casing.

7. The munition of claim 6, wherein the electrical harness is coupled to the nose kit.

8. The munition of claim 6, wherein the nose kit is coupled to a forward connection of the enclosure.

9. The munition of claim 8, wherein the electrical harness is between the casing and the enclosure, running along an outer surface of the casing.

10. The munition of claim 1, wherein the munition includes a tail kit aft of the penetrator casing.

11. The munition of claim 10, wherein the tail kit is coupled to an aft connection of the enclosure.

12. The munition of claim 1, wherein the casing has a series of elongate reduced-thickness portions, thinner than portions of the casing that are adjacent the reduced-thickness portions.

13. The munition of claim 12, wherein the elongate reduced-thickness portions are non-intersecting elongate reduced-thickness portions.

14. The munition of claim 12, wherein the reduced-thickness portions are parts of the aft section.

15. The munition of claim 14, wherein the aft section is substantially cylindrical.

16. The munition of claim 12, further comprising a lethality-enhancement material located at the reduced-thickness portions of the penetrator casing.

17. The munition of claim 1, further comprising a fuzewell;

wherein the fuze is located in the fuzewell.

18. The munition of claim 1, wherein the electrical harness is between the casing and the enclosure, running along an outer surface of the casing.

* * * * *